US005743755A

United States Patent [19]

Aoki

[11] Patent Number: 5,743,755

[45] Date of Patent: Apr. 28, 1998

[54] CONNECTOR SYSTEM

[75] Inventor: Yoshihito Aoki, Susono, Japan

[73] Assignee: Yazaki Corporation, Tokyo, Japan

[21] Appl. No.: 769,527

[22] Filed: Dec. 19, 1996

[30] Foreign Application Priority Data

Dec. 22, 1995 [JP] Japan ..... 7-334776

[51] Int. Cl.[6] ..... H01R 13/627; H01R 9/09; H01R 13/62

[52] U.S. Cl. ..... 439/354; 439/74; 439/310

[58] Field of Search ..... 439/310, 152–157, 439/354, 357, 32, 74, 533

[56] References Cited

U.S. PATENT DOCUMENTS

| | | | |
|---|---|---|---|
| 5,190,461 | 3/1993 | Oorui et al. | 439/74 |
| 5,252,089 | 10/1993 | Hatagishi et al. | 439/310 |
| 5,467,023 | 11/1995 | Takeyama | 439/510 |
| 5,536,178 | 7/1996 | Novelli | 439/74 |

FOREIGN PATENT DOCUMENTS 5-207628 8/1993 Japan .

6-215831 8/1994 Japan .

*Primary Examiner*—Hien Vu

*Attorney, Agent, or Firm*—Armstrong, Westerman, Hattori, McLeland & Naughton

[57] ABSTRACT

The first connector includes a first connector housing and a second connector housing movable to and from said first connector housing, and the second connector includes a third connector housing to be coupled with the second housing. The first connector housing incorporates a connection terminal, said second connector housing incorporates a movable contact piece arranged within a terminal chamber and slidably coupled with said connection terminal, and the third terminal incorporates an electrical contact piece to be electrically connected to said movable contact piece. The first connector is mounted on a first mounting module, and the second connector is mounted on the second mounting module. The first mounting module and the second mounting module are coupled with each other. When the second connector housing is moved toward the third connector housing of the second connector, electrical connection between both connectors and fixing of the coupled mounting modules can be simultaneously carried out.

5 Claims, 5 Drawing Sheets

CONNECTOR SYSTEM

BACKGROUND OF THE INVENTION

1. Field of the Invention

The present invention relates to a connector system, and more particularly to a connector system serving as a fixing jig which can make electrical connection between both connectors and coupling of mounting modules incorporating the connector elements, respectively.

2. Description of the Related Art

In mounting electric appliances such as a room lamp on the ceiling of a vehicle room and making their electric wiring, a worker must enter a narrow room and carry out the work in his posture always looking up at the ceiling. For this reason, he is very tired to make it impossible to continue the works for a long time.

A typical method of simplifying the works to relieve his fatigue and improving productivity is disclosed in JP-A-5-207628. This reference proposes a method of attaching a mounting module b previously equipped with an electric wire and an electric appliance on the ceiling of a vehicle body a as shown in FIG. 6 so that the work of mounting the electric appliance and electric wiring is simplified.

The mounting module b includes a molded ceiling c of synthetic resin, several electric appliances such a room lamp, map lamp, etc. attached to the ceiling and plural wirings d connected to them by bonding by both side tape. Since the mounting module b can be manufactured in exterior factories, the work in an narrow vehicle room is limited to attach the mounting module b to the ceiling of the vehicle body a so that the operation of mounting an electric appliance and wiring can be simplified.

With respect to the mounting module b, however, electric appliances and a wiring d are arranged on the molded ceiling to be attached to the ceiling of the body a. Therefore, the wiring d arranged on the mounting module b is connected to the main wiring harness of the body through a connector e drawn out from the mounting module b. Thus, the problem of a difficult work in a narrow vehicle room remains unsolved.

SUMMARY OF THE INVENTION

An object of the present invention is to provide a connector system serving as a fixing jig which can make electrical connection between both connectors and coupling of mounting modules incorporating the connector elements, respectively.

In order to attain the above object, there is provided a connector system comprising the first and the second connector to be coupled with each other, said first connector including a first connector housing and a second connector housing movable to and from said first connector housing; and said second connector including a third connector housing to be coupled with the second housing.

The connector system according to the present invention, preferably further comprises: a first mounting module on which said first connector is mounted; and a second mounting module on which said second connector is mounted, said first mounting module and said second mounting module being to be coupled with each other.

In the connector system, the first and second connector housings of the first connector and the third connector housing of the second connector are previously mounted on the first and second modules, respectively, and the first and second module modules are previously coupled with each other. In this state, since the second moving connector housing is moved toward the connector housing of the second connector, electrical connection between both connectors and fixing of the coupled mounting modules can be simultaneously carried out.

Such a connector system can be applied to the work of mounting electric appliances such as a room lamp on a ceiling of a vehicle room and making their electric wiring. Thus, the severe work carried out in a worker's posture always looking up at the ceiling can be simplified. This greatly improves the productivity of mounting work.

Since various mounting modules can be combined freely, the connector system according to the present invention can be applied to various car bodies. This permits to various kinds of options to be added or changed easily.

The above and other objects and features of the present invention will be more apparent from the following description taken in conjunction with the accompanying drawings.

DESCRIPTION OF THE PREFERRED EMBODIMENTS

Figure 1:
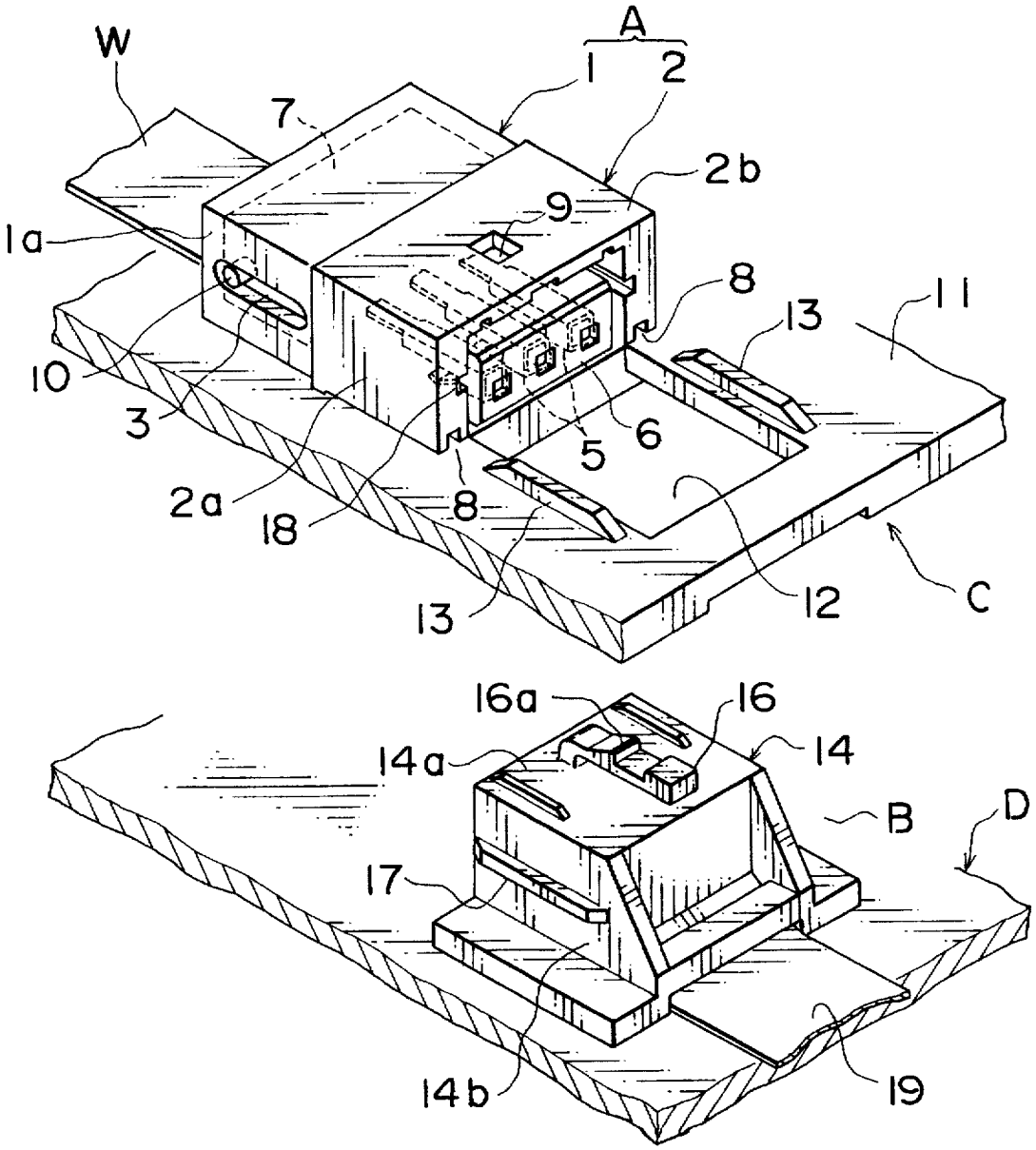
FIG. 1 is a perspective view of the state where a pair of connectors each serving as a fixing jig according to an embodiment of the present invention are attached to a pair of mounting modules, respectively.
Figure 2:
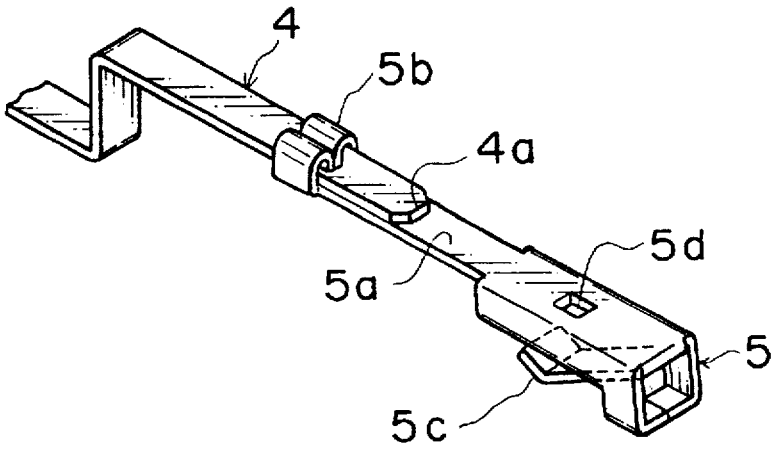
FIG. 2 is a perspective view showing a terminal and a moving contact piece accommodated in a first connector shown in FIG. 1.
Figure 3:
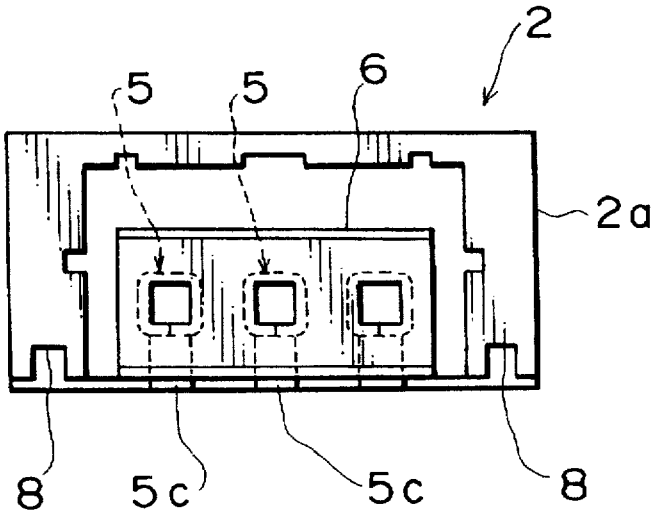
FIG. 3 is a front view of a moving connector housing shown in FIG. 1.

Now referring to the drawings, an explanation will be given of an embodiment of the present invention.

FIG. 1 is a perspective view of the state where a pair of connectors A and B each serving as a fixing jig according to the present invention are attached to a pair of mounting modules C and D.

The connector A includes a connector housing (first connector housing) 1 and a moving connector housing (second connector housing) 2 movable therefrom.

At the side wall of the connector housing 1, a lengthy-circle shaped groove 3 is formed. Within the connector housing 1, plural male-terminals 4 are arranged in parallel so that their terminals 4*a* face the moving connector housing 2. Box-shaped moving contact pieces are capable of being movably fitted in the male-shaped terminals 4, respectively.

Each of the moving contact pieces 5, which is formed by bending a thin metallic plate, includes a sliding supporting portion 5*b* acting to hold the terminal 4 at one end of its base plate area 5*a* and an electric contact portion 5*c* formed by bending the base plate area 5*a* and projecting downward from the other end of the base plate area 5*a*. The moving contact piece 5 further includes an engagement hole 5*d* on the upper face of the base plate area 5*a*.

The moving connector housing 2 has a box-shaped terminal chamber 6 for receiving each of the individual moving contact piece 5 formed on the front and a fitting-in section 7 formed on the rear side.

The terminal chamber 6 has a flexible securing piece 6*a* formed on the upper wall. The flexible securing piece 6*a* is engaged into a securing hole 5*d* of the moving contact piece so that the moving contact piece 5 is secured within the terminal chamber 6.

The moving connector housing 2 has also a guiding groove 8 formed on the lower side of the side wall 2*a* and a fixing hole 9 formed on the upper wall 2*b*.

The moving connector housing 2 is movable from and to the connector housing 1 in such a manner that its fitting-into section 7 is fitted into the connector housing 1 so that a protrusion 10 formed at the side wall of the fitting-into section 7 is engaged into the moving groove 3 of the connector housing 1.

The connector housing 1 is located in such a way that in the vicinity of an opening 12 made on a mold plate 11 of a mounting module C, the moving connector housing 2 is movable on the fitting opening 12. A circuit conductor W arranged on the mounting module C is connected to the terminals within the connector housing 1.

On both sides of the opening 12 of the mold plate 11, protrusive strips, capable of being respectively inserted into the guiding grooves 8, are formed.

The connector B has a plurality of electric contact pieces 15 (see FIG. 4) arranged within a box-shaped connector housing (third connector housing) 14 and a locking arm 16 having a securing protrusion 16*a* provided on the upper wall 14*a* of the connector housing 14.

The fixing hole 9 of the moving connector housing 2 is to be engaged with the securing protrusion 16*a* of the locking arm 16 to secure the connector housing 14 to the moving connector housing 2.

Figure 4:
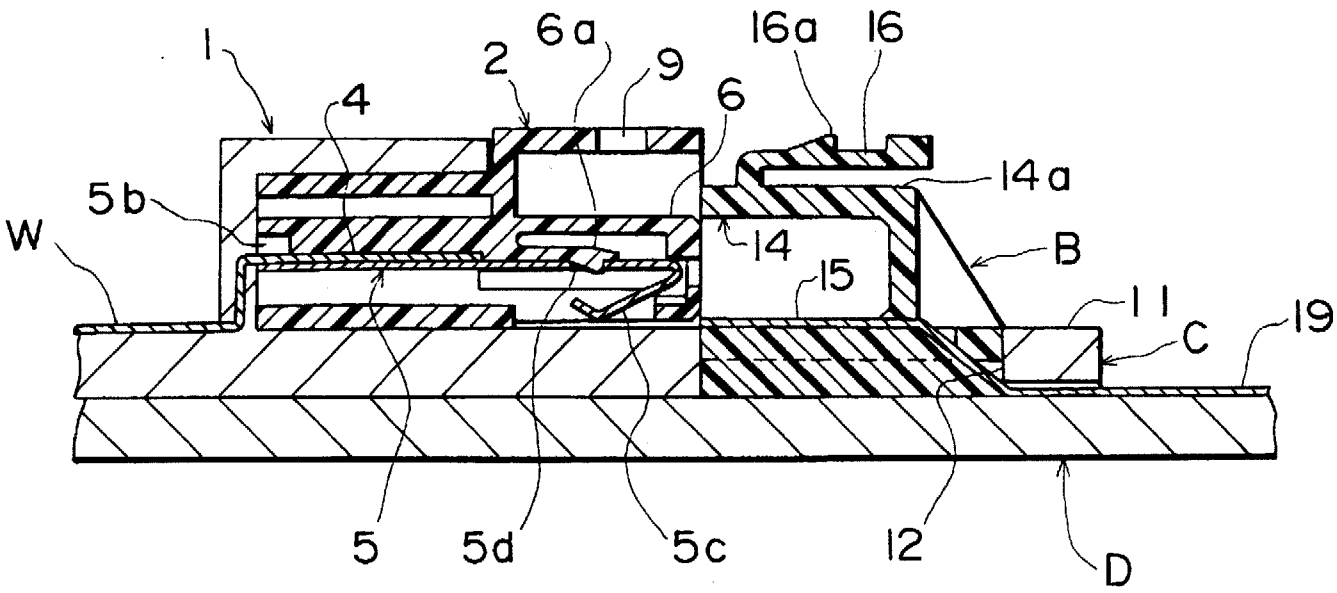
FIG. 4 is a sectional view of the state before the connectors shown in FIG. 1 are coupled with each other.

The connector housing 14 has introducing protrusions 17 formed on both side walls 14*b* to be engaged into introducing grooves 18 formed on the inner walls on both sides of the moving connector housing 2. As shown in FIG. 1, the connector housing 14 is attached to the mounting module D. The circuit conductor 19, arranged on the mounting module D, is connected to the electric contacts 15 of the connector housing 14 (FIG. 4).

The mounting module C, according to this embodiment has several interior decorations or electric appliances and electric wirings attached to the ceiling of the body of a vehicle (not shown). The mounting module D is a molded ceiling to be integrally coupled with the mounting module C and to be attached to the ceiling of the body, and is provided with a lamp and its wiring.

Figure 5:
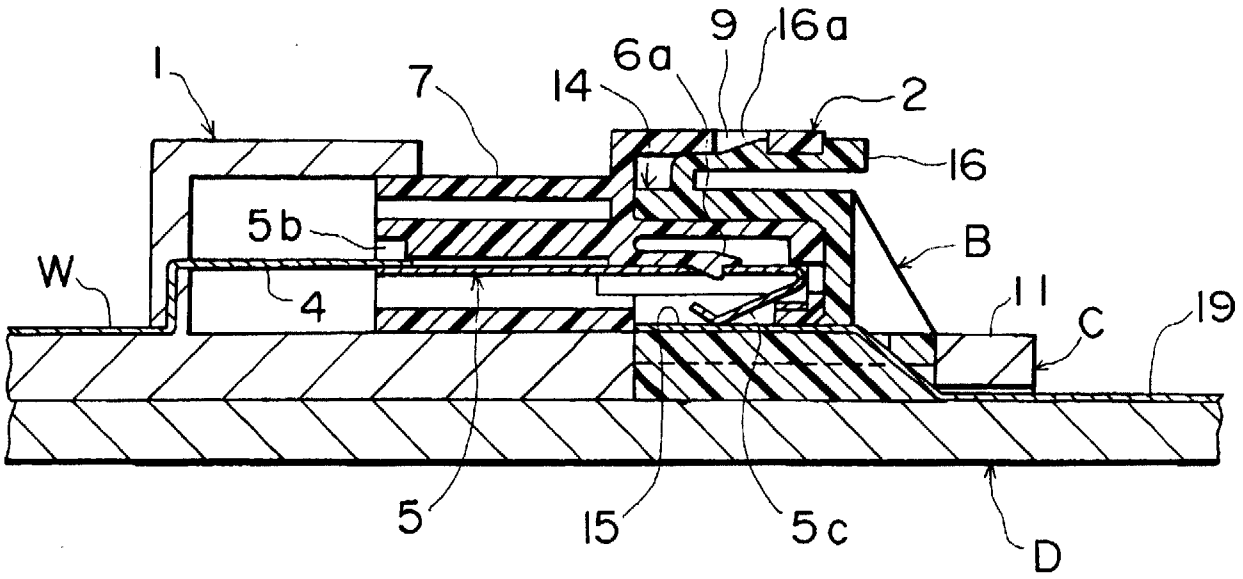
FIG. 5 is a sectional view of the state when the connectors are coupled with each other.
Figure 6:
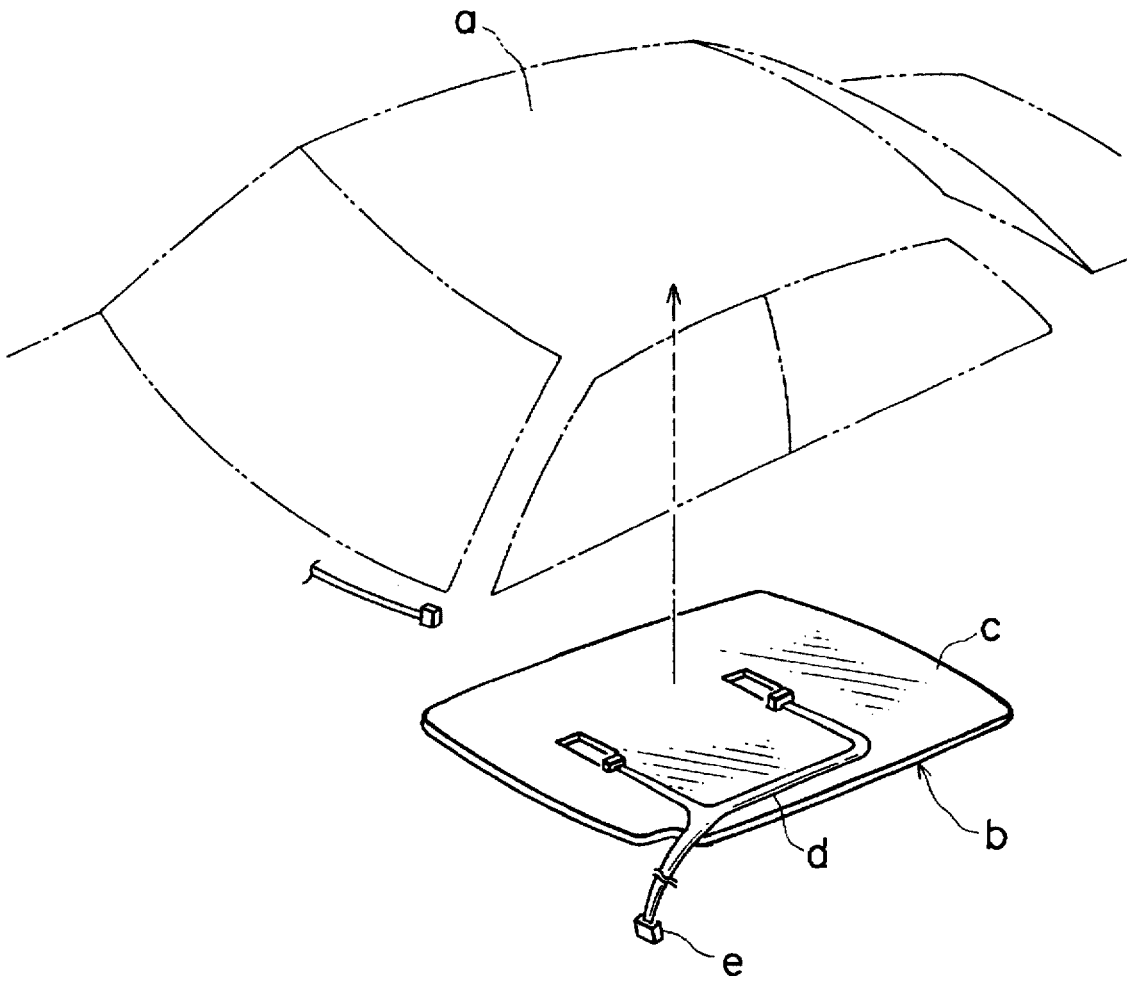
FIG. 6 is a perspective view of a conventional mounting module attached to the ceiling of a car body.

The connectors A and B are coupled with each other in such a way that the connector housing 14 of the connector B is fitted into the opening 12 of the mounting module C in order to protrude upward from the molded base plate 11. In this state, when the moving connector housing 2 of the connector A is moved toward the connector housing 14, as shown in FIG. 5, the connector housing 14 is fitted into the moving connector housing 2, and the terminal chamber 6 advances into the connector housing 14. Thus, the electric contact area 5*b* of each of the moving contact pieces 5 is brought into electric contact with each electric contact 15 within the connector housing 14. It should be noted that the terminal has a length enough to assure conduction with the moving contact pieces 5 even when the moving contact pieces 5 are advanced into the connector housing 14.

When the moving connector housing 2 and the connector housing 14 are completely coupled with each other, the securing protrusion 16*a* of the locking arm 16 is fit into fixing hole 9 of the moving connector housing 2. Thus, the moving housing 2 is locked to the connector housing 14. The mounting modules C and D are also completely coupled with each other.

What is claimed is:

1. A connector system comprising:

a first connector including a first connector housing and a second connector housing movable to and from said first connector housing; and a second connector to be coupled to said first connector, said second connector including a third connector housing to be coupled with the second connector housing, wherein said first connector housing includes a connection terminal, said second connector housing includes a movable contact piece arranged within a terminal chamber and slidably coupled with said connection terminal, and said third connector housing includes an electrical contact piece to be electrically connected to said movable contact piece.

2. A connector system according to claim 1, further comprising:

a first mounting module on which said first connector is mounted; and a second mounting module on which said second connector is mounted, said first mounting module and said second mounting module being adapted to be coupled with each other.

3. A connector system according to claim 2, wherein said first mounting module has an opening through which said third connector housing is to be passed when said second connector housing of said first connector is coupled to said third connector housing of said second connector.

4. A connector system according to claim 3, wherein a hole is formed in an upper wall of said second connector housing and a protrusion is formed on an upper wall of said third connector housing, said protrusion being engaged with said hole when said second connector housing and said third connector housing are completely coupled with each other.

5. A connector system according to claim 1, wherein said connection terminal is a male type and said contact piece has a holder for holding said connection terminal.

* * * * *